US006231358B1

(12) United States Patent
Kerr, Jr. et al.

(10) Patent No.: US 6,231,358 B1
(45) Date of Patent: May 15, 2001

(54) ELECTRICAL PLUG AND RECEPTACLE HAVING SAFETY FEATURES

(75) Inventors: Jack Russell Kerr, Jr., College Station, TX (US); Barton A. Pasternak, Elkins Park, PA (US)

(73) Assignee: Angelo Fan Brace Licensing, L.L.C., Philadelphia, PA (US)

( * ) Notice: Subject to any disclaimer, the term of this patent is extended or adjusted under 35 U.S.C. 154(b) by 0 days.

(21) Appl. No.: 09/553,184

(22) Filed: Apr. 19, 2000

Related U.S. Application Data

(60) Provisional application No. 60/174,736, filed on Jan. 6, 2000.

(51) Int. Cl.[7] ..... H01R 13/44

(52) U.S. Cl. ..... 439/140; 439/141

(58) Field of Search ..... 439/139, 140, 439/141, 682, 692, 693, 915, 536, 650; 220/241; 174/66

(56) References Cited

U.S. PATENT DOCUMENTS

| | | | |
|---|---|---|---|
| Re. 18,193 | 9/1931 | Kollath . | |
| 714,869 | 12/1902 | Cravens . | |
| 1,170,959 | 2/1916 | Campbell . | |
| 1,212,699 | 1/1917 | Smith . | |
| 1,435,819 | 11/1922 | Des Isles . | |
| 2,059,008 | 10/1936 | Marquart | 173/328 |
| 2,386,177 | 10/1945 | Andersen | 173/328 |

(List continued on next page.)

FOREIGN PATENT DOCUMENTS

| | | |
|---|---|---|
| 500643 | 3/1954 | (CA) . |
| 435907 | 11/1926 | (DE) . |
| 722858 | 7/1942 | (DE) . |
| 850166 | 9/1952 | (DE) . |
| 1665408 | 3/1971 | (DE) . |
| 2758806 | 7/1978 | (DE) . |
| 571081 | 5/1924 | (FR) . |
| 1463131 | 11/1965 | (FR) . |
| 27541 | of 1899 | (GB) . |
| 628647 | 9/1949 | (GB) . |
| 645816 | 11/1950 | (GB) . |
| 703093 | 1/1954 | (GB) . |
| 965353 | 7/1964 | (GB) . |
| 336158 | 10/1936 | (IT) . |
| 527883 | 6/1955 | (IT) . |
| 58588 | 12/1946 | (NL) . |

OTHER PUBLICATIONS

Eight page ITT Cannon Electric document designated 339–184.M 53, date unknown.

*Primary Examiner*—Paula Bradley
*Assistant Examiner*—Tho D. Ta
(74) *Attorney, Agent, or Firm*—Seidel, Gonda, Lavorgnia & Monaco, PC

(57) ABSTRACT

An electrical plug and receptacle having safety features is provided. The plug includes a body, at least two conductors, and a skirt. The conductors extend from the body and are laterally surrounded by the skirt. The skirt is retractable into the body so that when the plug is used with a conventional receptacle, the skirt retracts into the body as the conductors are inserted the sockets of the receptacle, shielding a user from inadvertently touching the conductors. The plug further includes a toggle stop that locks the skirt into its fully extended position for using the plug with a safety electrical outlet assembly of the present invention. The safety outlet assembly includes a cover and a receptacle adapted to be secured to an electrical junction box. The receptacle has a receiver adapted to matingly engage the skirt on the safety plug. The cover is removably secured to the receptacle and includes an aperture having a periphery spaced-apart from the outer periphery of the receiver to define an opening for receiving a skirt of a safety plug.

6 Claims, 7 Drawing Sheets

U.S. PATENT DOCUMENTS

| | | | | |
|---|---|---|---|---|
| 2,396,901 | * | 3/1946 | Tiffany | 439/140 |
| 2,410,618 | | 11/1946 | Zelov | 173/328 |
| 2,477,862 | | 8/1949 | Cook | 171/97 |
| 3,046,512 | | 7/1962 | Remke et al. | 339/14 |
| 3,157,450 | | 11/1964 | Harison, Sr. et al. | 339/94 |
| 3,199,060 | | 8/1965 | Marasco | 339/60 |
| 3,271,727 | | 9/1966 | Nelson | 339/60 |
| 3,281,758 | * | 10/1966 | Appleton | 439/536 |
| 3,315,214 | | 4/1967 | Davis | 339/94 |
| 3,328,745 | | 6/1967 | Paullus | 339/61 |
| 3,562,696 | | 2/1971 | Barnhart et al. | 339/60 |
| 3,629,791 | | 12/1971 | Normann | 339/45 M |
| 3,764,957 | | 10/1973 | Iversen | 339/92 R |
| 3,795,883 | | 3/1974 | Ackerman et al. | 339/14 P |
| 3,885,849 | | 5/1975 | Bailey et al. | 339/31 R |
| 3,926,499 | | 12/1975 | Bailey et al. | 339/136 R |
| 3,953,099 | | 4/1976 | Wilson | 339/60 M |
| 4,284,312 | | 8/1981 | Patchett et al. | 339/60 R |
| 4,304,457 | | 12/1981 | Lissau | 339/256 R |
| 4,403,824 | | 9/1983 | Scott | 339/186 R |
| 4,420,209 | | 12/1983 | Reis et al. | 339/91 R |
| 4,725,240 | | 2/1988 | Braverman | 439/105 |
| 4,810,199 | * | 3/1989 | Kar | 439/141 |
| 4,934,963 | | 6/1990 | Gardner et al. | 439/677 |
| 5,160,281 | | 11/1992 | Culver et al. | 439/692 |
| 5,222,899 | * | 6/1993 | Hulderman | 439/141 |
| 5,248,268 | | 9/1993 | Rinker | 439/682 |
| 5,282,757 | | 2/1994 | Maeda | 439/374 |
| 5,413,506 | | 5/1995 | Thompson | 439/660 |
| 5,564,951 | | 10/1996 | Attal et al. | 439/676 |
| 5,599,196 | * | 2/1997 | Powell et al. | 439/141 |
| 6,062,881 | * | 5/2000 | Ellison | 439/141 |

* cited by examiner

ELECTRICAL PLUG AND RECEPTACLE HAVING SAFETY FEATURES

CROSS-REFERENCE TO RELATED APPLICATION

This application claims priority from a provisional application entitled "Electrical Plug And Receptacle Having Safety Features," Ser. No. 60/174,736, filed Jan. 6, 2000.

FIELD OF THE INVENTION

The present invention relates generally to electrical connectors and, more particularly, to an electrical plug and receptacle having safety features for protecting a user from receiving an electrical shock while the user is engaging or disengaging the plug from the receptacle.

BACKGROUND OF THE INVENTION

Electrical plug and receptacle connections, particularly those carrying relatively large amounts of electricity, can pose several dangers, including fire and death. For example, common household electrical receptacles carry alternating current at either 120 volts or 240 volts. A typical plug used with these receptacles has either two or three conductors that extend unshielded from one end of the plug's body. Due to the length of the conductors and the locations of the contacts within the receiver, there is a point where the plug is energized but the conductors are not fully inserted into the receptacle, leaving portions of the energized conductors exposed on the top, sides, and bottom of the plug.

In such a partially-inserted position, there can be enough space between the plug body and the receptacle that an object or a person's finger, particularly a finger of an infant or young child, can contact one or more of the conductors. A person touching one of the energized conductors will receive a shock, possibly resulting in death. In addition, if an object made of a conductive material, such as a metal necklace, falls in the space between the plug body and receptacle and contacts two of the conductors, the object will cause a short circuit and possibly a spark that could cause a fire. Although the foregoing dangers are generally widely known and have been known for many years, the basic design of the household receptacles and plugs has not changed.

Several attempts have been made at providing electrical plugs and receptacles that provide safety features for preventing the above-mentioned dangers. For example, U.S. Pat. No. 5,248,268 to Rinker shows a safety plug and receptacle having a plug that includes non-conductive prongs that contain the conductors. The conductors cannot be touched while the prongs are being inserted into the mating receptacle. Another example is the shielded-conductor plug and receptacle shown in U.S. Pat. No. 4,725,240 to Braverman. This type of connection is designated as an IEC 320 connection. The problem with these safety plugs and receptacles is that they are not compatible with the many millions of conventional receptacles and plugs presently in use throughout the world.

In the United States, for example, if building codes were changed to require the general use of receptacles and plugs of the type shown in the Rinker patent, there would be a great resistance to a change-over because the new receptacles would not be compatible with existing plugs and the new plugs would not be compatible with existing receptacles. A similar situation would result from a requirement to switch to using the IEC 320 type connection shown in the Braverman patent. Although IEC 320 connections are currently available, they are generally used only at the end(s) of a power cord that engage(s) a piece of equipment, such as a computer CPU housing and/or monitor.

SUMMARY OF THE INVENTION

The present invention is directed to an electrical plug and receptacle having safety features. In one aspect, the invention comprises an electrical outlet assembly for an electrical junction box. The assembly includes a receptacle having a base. A receiver is attached to the base, and a plurality of sockets extend into the receiver The receiver is adapted to matingly engage a skirt of a safety plug, and each socket is adapted to receive a conductor of a plug. The assembly further includes a cover formed separately from the receptacle and removably secured to the receptacle. The cover includes an aperture having an inner periphery spaced apart from and surrounding the receiver. The space between the inner periphery and the receiver defines an opening adapted to receive a skirt of a safety plug.

In another aspect, the present invention comprises an electrical safety plug. The plug includes a body having a front surface and a plurality of conductors engaging the body. Each conductor has a contact portion extending away from the front face in substantially parallel relation to the other conductors. The plug further includes a retractable skirt slidably engaging the body. The skirt has an inner peripheral surface and a free end. The skirt has an extended position wherein the free end is located distal from the front face of the body, the inner peripheral surface and the front face defining a cavity substantially containing the contact portions of the conductors. The skirt also has a retracted position wherein the free end is located proximal to front face.

BRIEF DESCRIPTION OF THE DRAWINGS

For the purpose of illustrating the invention, the drawings show a form of the invention that is presently preferred. However, it should be understood that the invention is not limited to the precise arrangements and instrumentalities shown in the drawings.

DETAILED DESCRIPTION OF THE DRAWINGS

Figure 1:
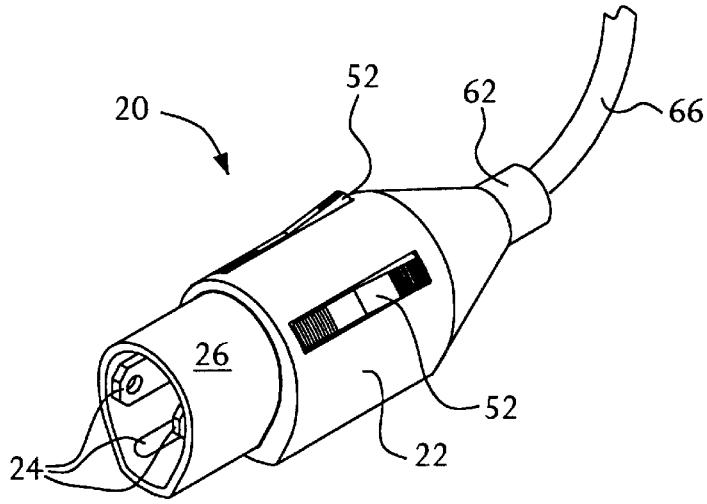
FIG. 1 is a perspective view illustrating a safety plug according to the present invention.
Figure 2:
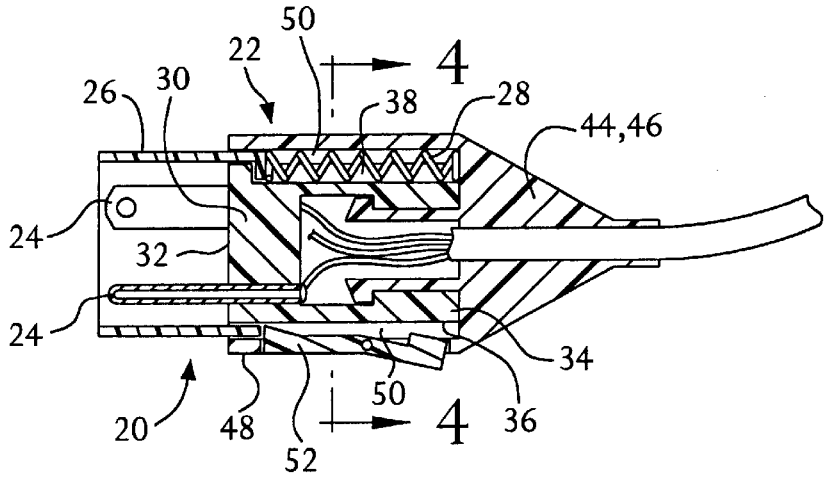
FIG. 2 is a longitudinal cross-sectional view of the safety plug of FIG. 1 showing the retractable skirt in its fully extended position.
Figure 3:
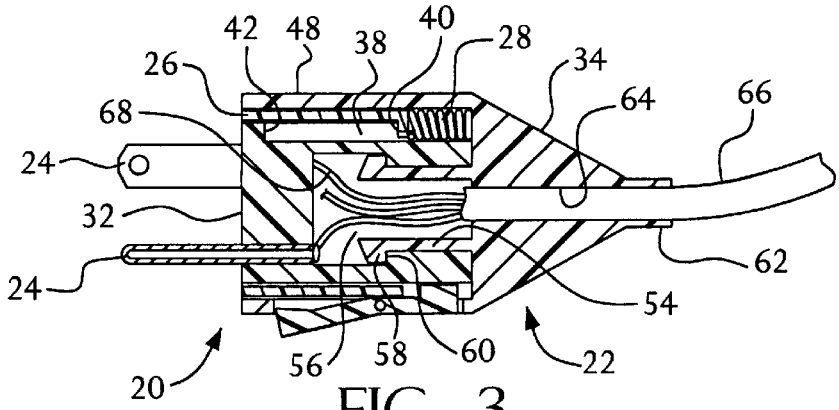
FIG. 3 is a longitudinal cross-sectional view of the safety plug of FIG. 1 showing the retractable skirt in its retracted position.
Figure 4:
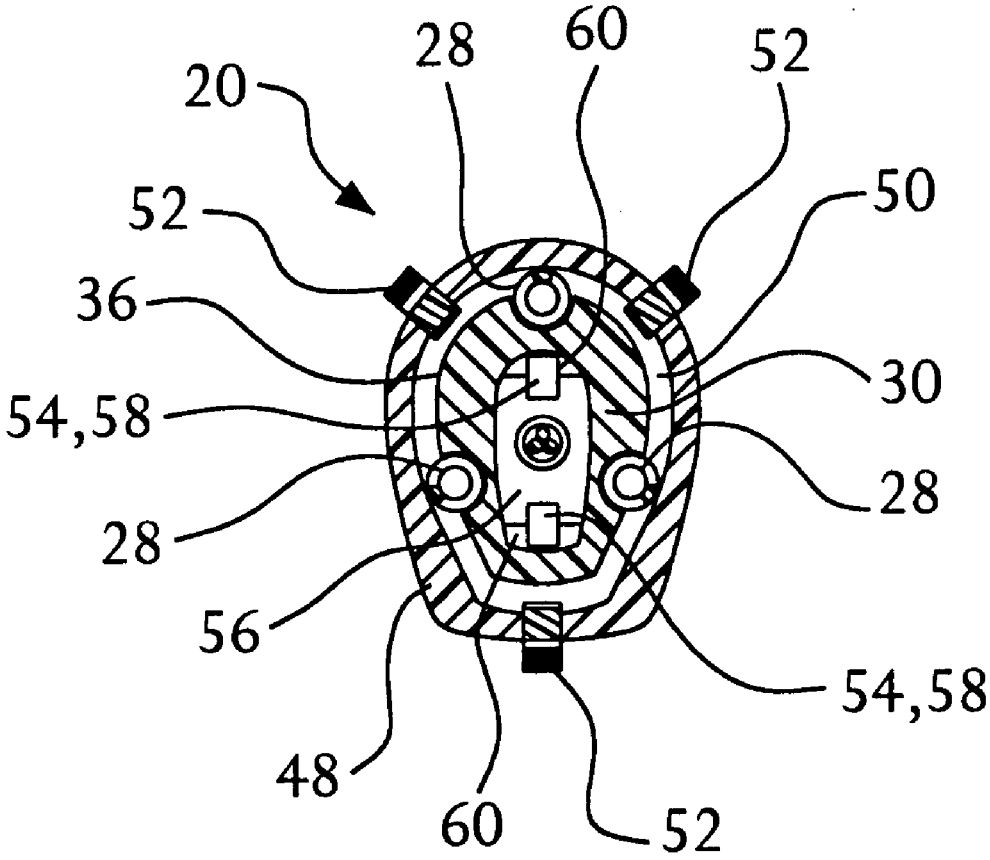
FIG. 4 is a cross-sectional view of the safety plug taken along line 4—4 of FIG. 2.

Referring to the drawings, wherein like numerals indicate like elements, FIGS. 1–4 illustrate a electrical safety plug, which is designated generally by the numeral 20. The plug 20 includes a body 22, a plurality of conductors 24, and a skirt 26 that may be retracted into the body against the biasing force of three springs 28 located at approximately one-third points around the periphery of the plug 20. In its fully extended position, as shown in FIGS. 1 and 2, the skirt 26 laterally surrounds the conductors 24. When retracted into the body 22, for example as shown in FIG. 3, the conductors 24 are exposed, allowing them to engage the mating sockets of a conventional receptacle (not shown), such as a receptacle of household wall outlet.

The plug 20 may also be used with a corresponding safety receptacle, for example, those shown in FIGS. 6–17 and described below. Such a safety receptacle includes a receiver that matingly engages the skirt in its fully extended position. In addition to the providing a safety shield, the skirt can also provide a means for properly aligning the plug with the receptacle. Moreover, providing a snug fit between the skirt and the receiver of a safety receptacle provides a more secure engagement between the plug and receptacle that reduces the likelihood that the plug will be inadvertently disengaged from the receptacle.

When the plug 20 is engaged with a conventional receptacle, the end of the skirt 26 proximal to the receptacle engages the face of the receptacle. As the conductors are inserted into the sockets of the receptacle, the skirt 26 is pushed into the body 22 against the biasing force of the springs 28. Since the skirt 26 engages the receptacle before the conductors 24 enter the sockets, it shields a user from contacting the conductors 24 during the entire time the conductors 24 are being inserted into the sockets. Similarly, the skirt 26 shields a user from the conductors 24 as the plug 20 is being pulled from the receptacle. The biasing force of the spring 28 keeps the skirt 26 engaged with the face of the receptacle as the conductors 24 are being pulled from the sockets. In addition, if the conductors 24 were to partially back out of the sockets while still being energized, the springs 28 hold the skirt 26 against the face of the receptacle, preventing foreign objects, finger, or the like from touch the conductors 24.

The body 22 includes a core 30 having a front end 32, a rear end 34, and an outer peripheral surface 36. The front end 32 is generally planar so that the plug 20 may properly engage a generally flat-faced receptacle. The core 30 preferably is made entirely of a non-conductive material and molded around the conductors 24 to secure the conductors 24 to the body 22. However, the core may be made of any material or combination of materials desired, and the conductors may be secured to the body with mechanical fasteners, an adhesive, or the like. The outer peripheral surface 36 slidably engages the skirt 26 and is generally smooth, except for three longitudinal channels 38 that each receive a corresponding one of the springs 28 and a corresponding one of three tabs 40 on the skirt 26. The channels 38 and springs 28 are preferably spaced at approximately one-third points around the outer periphery of the core 30 to provide a relatively even distribution of biasing forces to the skirt 26. Each channel 38 extends from the rear end 34 to a front wall 42 adjacent the front end 32. The front walls 42 provide stops for the tabs 40 that retain the skirt 26 on the core 30 when the skirt 26 is in its fully extended position. The springs 28 are preferably coil-type springs.

The body 22 further includes a cap 44 comprising a base 46 and a housing 48, which are preferably made of a non-conductive material and are formed integrally with one another. Alternatively, the base and the housing may be made of a conductive material or a combination of conductive and non-conductive material and may be formed separately from one another and attached together by adhesive bonding, heat welding, or the like. The housing 48 extends from adjacent the rear end 34 of the core 30 to adjacent the front end 32 and is laterally spaced from the outer peripheral surface 36 to form a recess 50 for containing the skirt 26 in a retracted position. In an alternative embodiment, the housing may be eliminated such that the skirt is exposed to view from end to end when it is in a retracted position.

The housing 48 supports three toggle stops 52 located at approximately one-third points around the circumference of the housing 48, alternatingly with the springs 28. Three generally equally spaced stops 52 are preferred to prevent unwanted rocking of the skirt 26 relative to the core 30. However, more or fewer toggle stops may be provided. Each toggle stop 52 has an engaged position (FIGS. 1, 2 and 5) wherein one end of the stop 52 engages the skirt 26 to prevent the skirt 26 from retracting into the body 22 and a disengaged position (FIG. 3) wherein the skirt 26 may be retracted into the body 22. It is desirable to place the toggle stops 52 into their engaged position when using the plug 20 with a receptacle of the present invention, which has a receiver that matingly engages the skirt 26. The toggle stops' disengaged position allows the plug 20 to be used with conventional receptacles.

Although it is preferable to provide a means for locking the skirt into its extended position, such a means may be eliminated. In addition, the locking means may be other than one or more toggle stops. The locking means may comprise a ring rotatably mounted to the outer peripheral surface of the housing. The ring would have one or more sloped tabs on its inner surface for engaging an outward projection formed on the free end of a cantilevered flexible finger formed either circumferentially or longitudinally in the housing. As the ring is rotated in one direction, the sloped tab engages the outward projection, pushing the free end of the finger inward toward the core such that the free end of the finger blocks the skirt from being retracted into the body. When the ring is rotated in the opposite direction, the sloped tab gradually disengages the outward projection, allowing the finger to resiliently rebound to its undeflected position.

The cap 44 is secured to the core 30 by two fingers 54 that extend into a cavity 56 formed within the core 30. Each finger 54 has an outwardly extending tab 58 that engages a shoulder 60 formed in the core 30 to provide a snap fit connection. Although a snap-fit connection is shown, the cap may be attached to the core by other means, such as mechanical fasteners, a threaded connection, an adhesive, or the like. In the embodiment shown, the snap fit connection is preferred because it prevents a user from tampering with the electrical connections inside the core. Once the tabs 58 engage the shoulder 60, the cap 44 cannot be removed. However, in an alternative embodiment, such as a rewireable embodiment wherein a user must access terminals contained within the core, the cap may be attached using a removable snap-fit connection, mechanical fasteners, or the like. The cap 44 provides a surface against which the springs 28 react to provide the force that biases the skirt 26 toward its fully extended position.

The base 46 is a generally solid member having a sleeve 62 at one end and a central bore 64, which contains a portion of a power cord 66. Before final assembly, the base 46 is slidably engaged with the power cord 66 so that the electrical connections between the conductors 24 and the wires 68 can be made before securing the cap 44 to the core 30. After the cap 44 is secured to the core 30, the base 46 may be attached to the power cord 66, preferably by heat fusing the sleeve 62 to the power cord 66. Connecting the base 46 to the power cord 66 in this manner allows any stresses, for example due to a user disengaging the plug 20 from a receptacle by pulling on the cord 66 instead of the body 22, to be carried directly from the cord 66 into the body 22, rather than through the electrical connections between the wires 68 and the conductors 24.

The preferred safety plug is designed to meet the National Electronics Manufacturers Association NEMA 5-15 standard for conductor configuration and arrangement. However, one skilled in the art will recognize that a plug according to the present invention may be modified for other types of conductors and conductor arrangement. Moreover, the transverse cross-sectional shapes of the housing, skirt, and core need not be the oblong shape shown in the drawings. The cross-sectional shape of these components may be any shape configuration and arrangement of the conductors.

Figure 5:
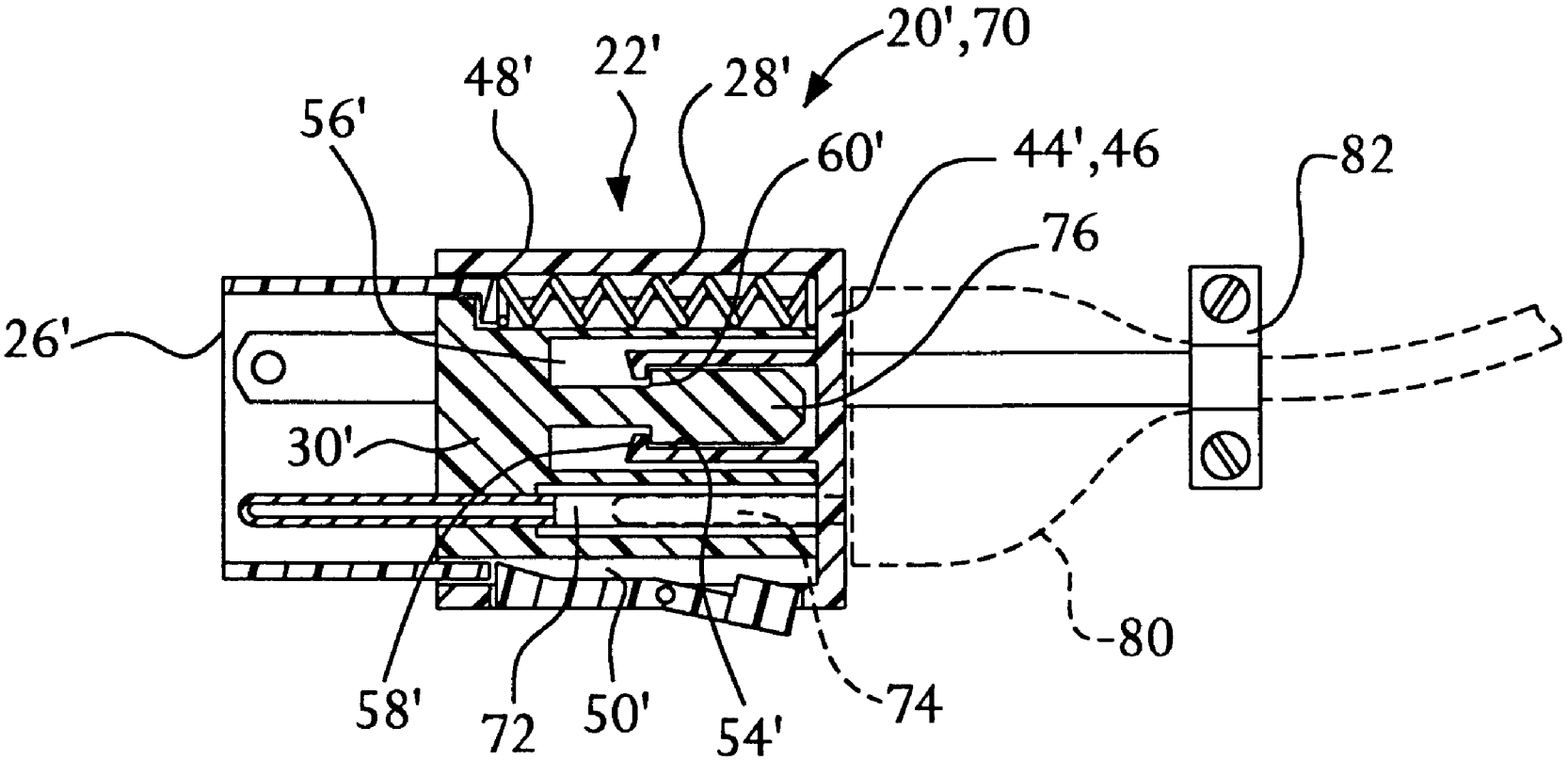
FIG. 5 is a longitudinal view illustrating an alternative embodiment of a plug according to the present invention, wherein the plug functions as an adapter for a conventional plug.
Figure 6:
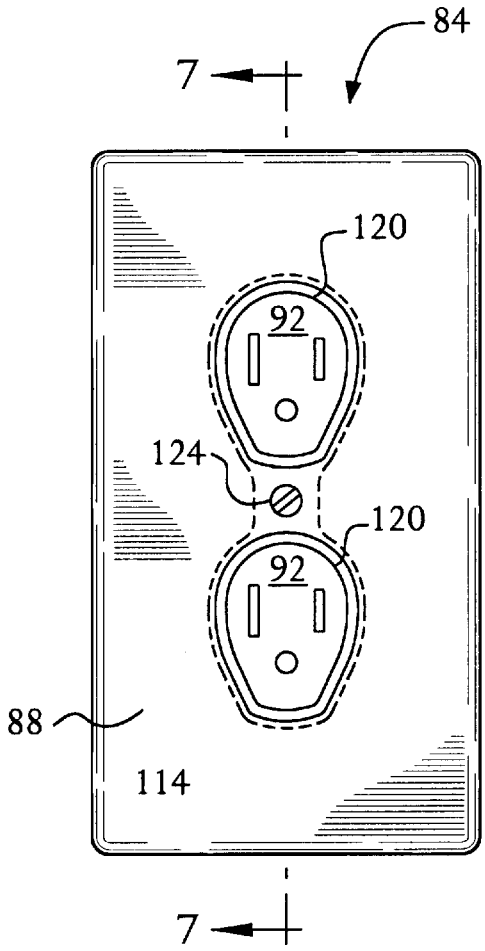
FIG. 6 is a front elevational view illustrating an electrical outlet according to the present invention.
Figure 7:
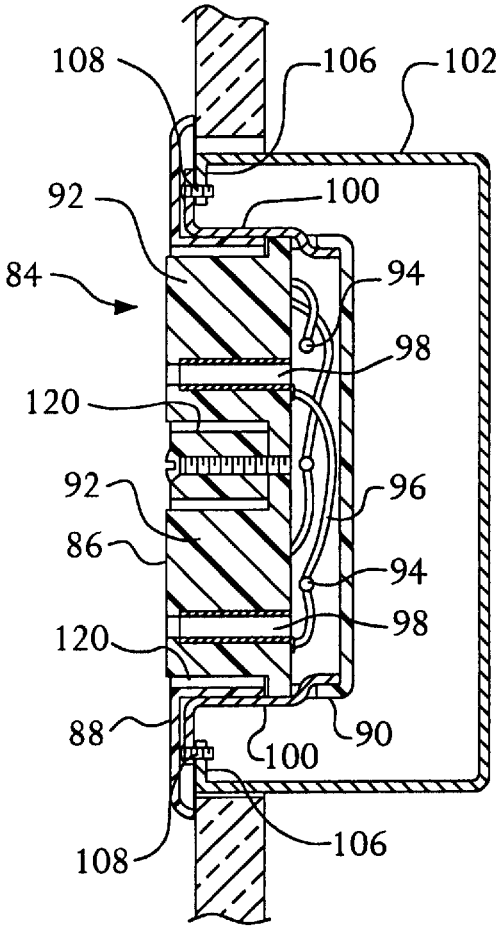
FIG. 7 is a cross-sectional view of the electrical outlet of FIG. 6 taken along line 7—7.
Figure 8:
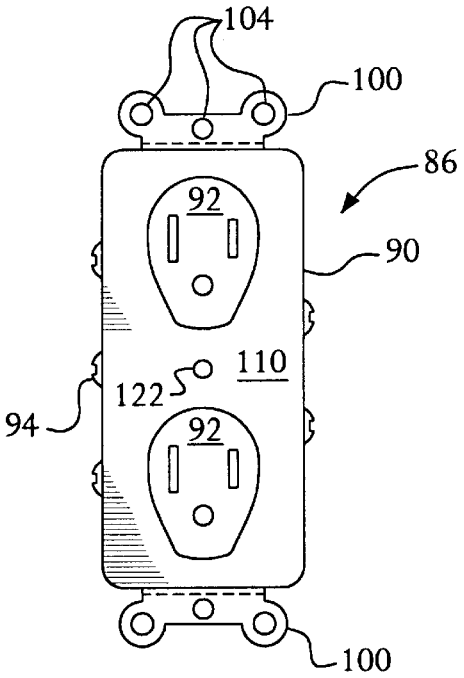
FIG. 8 is a front elevational view of the receptacle of the electrical outlet shown in FIG. 6.
Figure 9:
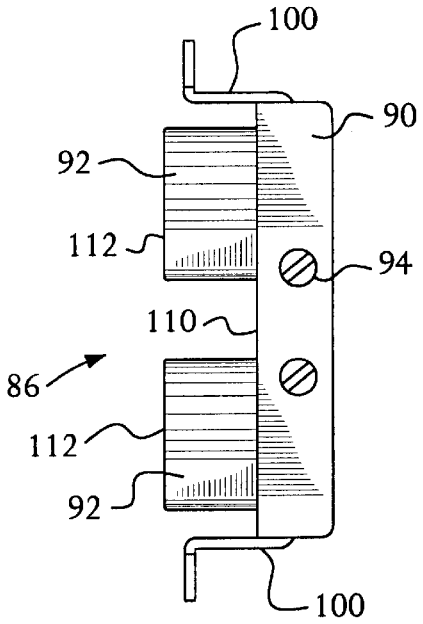
FIG. 9 is a side elevational view of the receptacle of the electrical outlet shown in FIG. 6.
Figure 10:
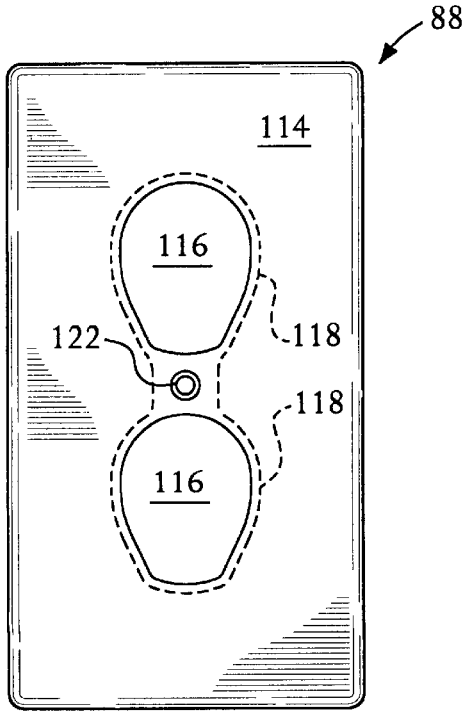
FIG. 10 is a front elevational view of the cover plate of the electrical outlet shown in FIG. 6.
Figure 11:
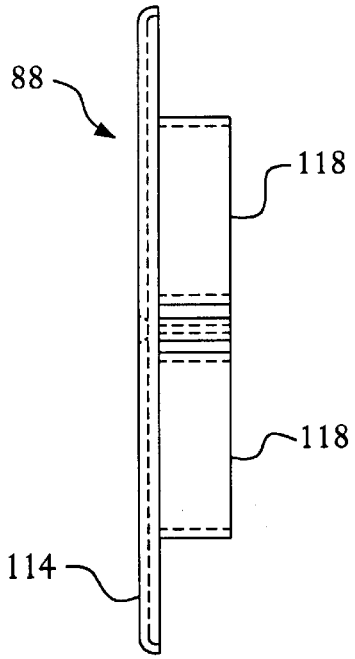
FIG. 11 is a side elevational view of the cover plate of the electrical outlet shown in FIG. 6.
Figure 12:
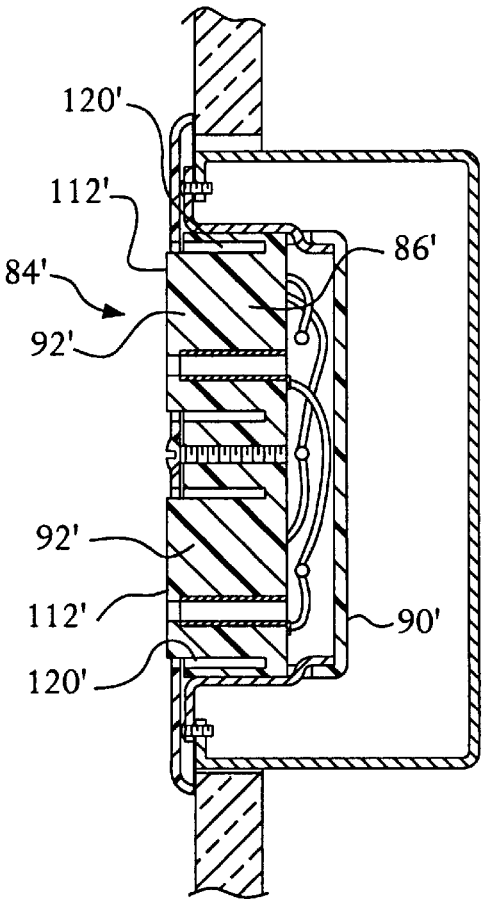
FIG. 12 is a front elevational view illustrating an alternative embodiment of an electrical outlet according to the present invention.
Figure 13:
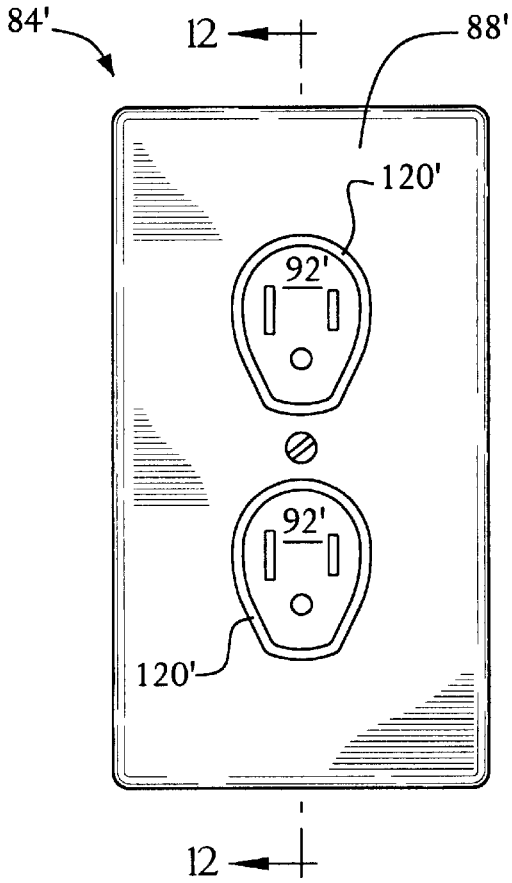
FIG. 13 is a cross-sectional view of the electrical outlet shown in FIG. 12 taken along line 7—7.
Figure 14:
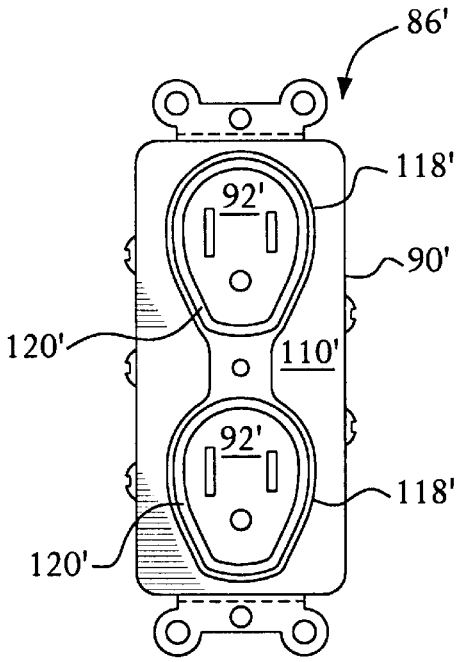
FIG. 14 is a front elevational view of the receptacle of the electrical outlet shown in FIG. 12.
Figure 15:
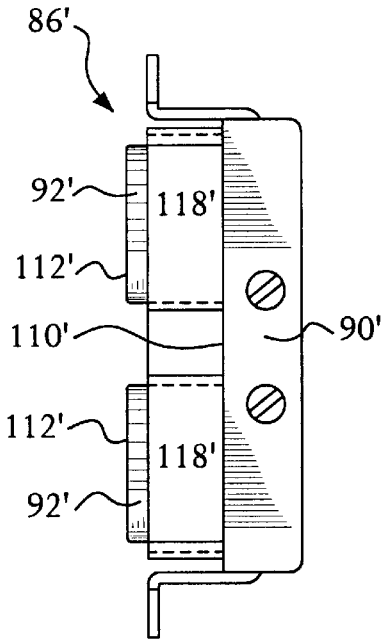
FIG. 15 is a side elevational view of the receptacle of the electrical outlet shown in FIG. 12.
Figure 16:
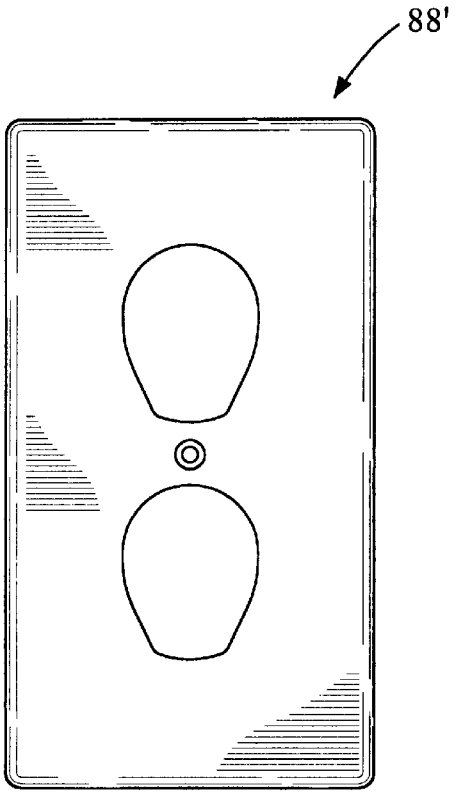
FIG. 16 is a front elevational view of the cover plate of the electrical outlet shown in FIG. 12.
Figure 17:
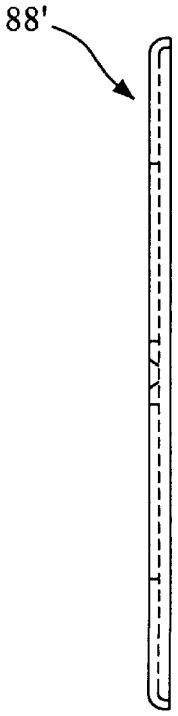
FIG. 17 is a side elevational view of the cover plate of the electrical outlet shown in FIG. 12.

Referring now to FIG. 5 there is shown an alternative embodiment of a safety plug 20' according to the present invention. The plug 20' is in the form of an adapter 70 for providing a conventional plug, for example, a three-prong NEMA 5-15 plug, with the safety benefits of a retractable skirt. Generally, the adapter 70 is similar to the corded plug 20 shown in FIGS. 1–4, except in place of the electrical cord 66, the body 22' is provided with sockets 72 for receiving prongs 74 of a conventional plug. In the preferred embodiment, the sockets 72 are standard sockets for receiving standard NEMA 5-15P conductors. However, the sockets may be sized and arranged for any size and configuration of conductors used.

Similar to the embodiment shown in FIGS. 1–4, the adapter includes a body 22' comprising a core 30' and a cap 44' comprising a base 46' and a housing 48'. The core 30' includes a cavity 561 in which is located a retainer 76 having a shoulder 60'. The retainer 76 may have a cross-sectional shape that is circular, rectangular, oval, or the like. The base 46' includes three apertures 78, each for receiving one of the prongs 74 of a conventional plug 80. The base 46' has a plurality of fingers 54' projecting into the cavity 56'. A tab 58' formed on the end of each finger 54' engages the shoulder 60' and secures the cap 44' to the core 30'. The adapter 70 includes a skirt 26' slidable retractable into a recess 50' formed between the core 30' and the housing 48'. The skirt 26' is biased toward its extended position (shown) by three springs 28' spaced approximately 120° apart around the periphery of the core 30'. The adapter 70 has a hold-down 82 that secures the plug 80 to the adapter 70 to prevent the plug 80 from disengaging the adapter 70 and exposing the prongs 74 to contact by a user or foreign object. The adapter may further include a shield (not shown) surrounding the plug as an additional measure of safety.

FIGS. 6–11 show a safety electrical outlet 84 of the present invention that may be used with the safety plug and adapter shown in FIGS. 1–5. The outlet 84 may also be used with a conventional plug or a safety plug similar to those shown in FIGS. 1–5, but which has a fixed skirt rather than a retractable skirt. The outlet 84 shown is intended to fit standard electrical junction boxes so that existing conventional outlets may be readily replaced with a safety outlet and new safety outlet installations are compatible with existing mounting hardware. However, the outlet may be modified to suit non-standard installations.

The safety outlet 84 comprises a receptacle 86 and a cover 88. The receptacle 86 has a base 90 and a pair of receivers 92, each for receiving a plug. Although the outlet is illustrated as having a pair of receivers, any number of receivers may be provided. Two receivers, however, correspond to the most common outlet configuration currently used for 120 volt alternating current in residential and light-commercial buildings.

The base 90 provides a common support for attaching the two receivers 92 to a junction box and a structure for supporting electrical terminals and containing the conductors 96 running from the terminals 94 to contacts 98 within the receivers 92. Preferably, the entire base 90 is made of a non-conductive material. However, it may be made of a combination of non-conductive and conductive materials. A pair of brackets 100 are attached to the base 90 for attaching the receptacle 86 to a junction box, such as the wall mounted box 102 illustrated in FIG. 7. Each bracket 100 is provided with several screw holes 104 configured for attaching the receptacle 86 to different types ofjunction boxes. The junction box 102 shown is of the type having two inwardly turned tabs 106 that each receive a pair of screws 108 that secure the receptacle to the junction box.

In the preferred embodiment, the receivers are formed integrally with the base. However, the receivers may be formed separately from the base and attached thereto by heat welding, adhesive bonding, chemical bonding, mechanical fastening, or the like. The base 90 includes a generally planar front surface 110. Each receiver 92 projects from the front surface 110 and terminates at a front face 112, which is generally parallel to the front surface 110. Each receiver 92 has a longitudinal cross-section shape that sized and shaped to slidably engage the inner periphery of a skirt of a safety plug, such as those shown in FIGS. 1–5.

The cover 88 comprises a generally flat plate 114 having a pair of apertures 116, each surrounded by a flange 118. The plate 114 covers the opening in the junction box 102 surrounding the two receivers 92. The sizes of the apertures 116 and flanges 118 are selected to provides a recess 120 around each receiver 92 for receiving a skirt of a safety plug. The cover 88 and the base 90 each include a screw hole 122 for receiving a screw 124 that secures the cover 88 to the receptacle 86.

The plate 114 and the flange 118 are preferably made of a nonconductive material, such as plastic, and formed integrally with one another. However, they may be formed separately and/or made of a conductive material such as metal. If the plate and flange are formed separately, they may be attached to one another by heat welding, adhesive bonding, chemical bonding, or the like. The end of the flange 118 opposite the plate 114 preferably contacts the front surface 110. However, the flange does not need to extend all the way to the flat surface. In an alternative embodiment, the receptacle may include a recess (not shown) in the front surface for matingly receiving the flange so that the cover cannot inadvertently rotate relative to the receptacle.

FIGS. 12–16 show and alternative embodiment of a safety outlet 84' according to the present invention. Similar to the embodiment shown in FIGS. 6–11, the present embodiment comprises a cover 88' and a receptacle 86' having a base 90' and two receivers 92' extending away from a front surface 110'. However, instead of the cover having a flange for forming a recess for receiving a skirt of a safety plug, the present embodiment has flanges 118' on the receptacle 86'. The flanges 118' defines two cavities 120' in which the receivers 92' are centrally located.

In the preferred embodiment, the flanges 118' do not extend away from the base 90' as far as the receivers 92' so that when the cover 88' is installed, the front faces 1 12' of the receivers 92' are generally flush with the outer face of the cover 88'. In an alternative embodiment, the cover may include a rabbet on the inner face of the plate adjacent each aperture for engaging the free end of the flange so that the plate does not inadvertently rotate about the screw relative to the receptacle. In yet another embodiment, the flange may be thickened so that it extends to the sides, top and bottom margins.

Although it is preferable to provide a flange between the cover and the receptacle to make the cover robust, the flange may be eliminated such that the spaced-apart relationship between the periphery of each aperture and the outer periphery of the corresponding receiver defines an opening that allows a skirt of a safety plug to matingly engage a corresponding one of the receivers.

Although the invention has been described and illustrated with respect to the exemplary embodiments thereof, it should be understood by those skilled in the art that the foregoing and various other changes, omissions, and additions may be made therein and thereto, without parting from the spirit and scope of the present invention.

What is claimed is:

1. An electrical plug, comprising:

a body having a core and a cap secured to the core, the core having a front face;

a plurality of conductors engaged with the core, each conductor having a contact portion extending away from the front face in substantially parallel relation to the other conductors;

a retractable skirt slidably engaging the core, the skirt having an inner peripheral surface and a free end, the skirt having an extended position wherein the free end is located distal from the front face of the core and the inner peripheral surface and the front face define a cavity substantially containing the contact portions of the conductors, and the skirt having a retracted position wherein the free end is located proximal to front face; and at least one stop located on the cap selectively engaging the skirt, the at least one stop for locking the skirt into its extended position.

2. The electrical plug of claim 1 wherein the skirt is biased into its extended position by at least one spring extending between the skirt and the body.

3. The electrical plug of claim 1 wherein the plug comprises an adapter plug and the plurality of conductors having a plurality of sockets for receiving a plurality of conductors of another plug.

4. The electrical plug of claim 1 wherein the core has an outer peripheral surface and the cap comprises a base portion and a sleeve portion, the base portion secured to the core, the sleeve portion having an inner peripheral surface located outwardly adjacent and laterally spaced apart from the outer peripheral surface of the core, the space between the inner and outer peripheral surfaces forming a recess for receiving the skirt when the skirt is in its retracted position.

5. The electrical plug of claim 4 further comprising at least one spring located within the recess, the spring biasing the skirt toward its extended position.

6. The electrical plug of claim 4 wherein the stop comprises a toggle pivotally attached to the sleeve.

* * * * *